US010309049B2

(12) United States Patent
Zhao et al.

(10) Patent No.: US 10,309,049 B2
(45) Date of Patent: Jun. 4, 2019

(54) WATER PURIFYING MODULE SELF-CLEANING METHOD AND WASHING MACHINE USING SAME

(71) Applicant: QINGDAO HAIER DRUM WASHING MACHINE CO., LTD., Shandong (CN)

(72) Inventors: Zhilong Zhao, Shandong (CN); Haitao Hu, Shandong (CN); Huibin Yang, Shandong (CN); Xianfeng Fan, Shandong (CN); Haifeng Ren, Shandong (CN); Qingjun Zhang, Shandong (CN); Yunfeng He, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 54 days.

(21) Appl. No.: 15/570,146

(22) PCT Filed: Apr. 15, 2016

(86) PCT No.: PCT/CN2016/079405
§ 371 (c)(1),
(2) Date: Oct. 27, 2017

(87) PCT Pub. No.: WO2016/173411
PCT Pub. Date: Nov. 3, 2016

(65) Prior Publication Data

US 2018/0142404 A1 May 24, 2018

(30) Foreign Application Priority Data

Apr. 29, 2015 (CN) ..... 2015 1 0213042

(51) Int. Cl.
*D06F 9/00* (2006.01)
*D06F 39/00* (2006.01)
(Continued)

(52) U.S. Cl.
CPC ..... *D06F 39/004* (2013.01); *A47L 15/0039* (2013.01); *A47L 15/0049* (2013.01);
(Continued)

(58) Field of Classification Search
CPC ..... D06F 39/004
See application file for complete search history.

(56) References Cited

U.S. PATENT DOCUMENTS

2005/0017114 A1* 1/2005 Gadini ..... A47L 15/4229 242/375.1

FOREIGN PATENT DOCUMENTS

CN 104032539 A 9/2014
CN 104342875 A 2/2015
(Continued)

OTHER PUBLICATIONS

International Search Report (PCT/ISA/210) dated Jul. 21, 2016, by the Chinese Patent Office as the International Searching Authority for International Application No. PCT/CN2016/079405.
(Continued)

*Primary Examiner* — Jason Y Ko
(74) *Attorney, Agent, or Firm* — Buchanan Ingersoll & Rooney PC

(57) ABSTRACT

Disclosed are a water purifying module self-cleaning method and a washing machine using the method. The water purifying module self-cleaning method comprises: starting a water purifying module self-cleaning program to feed water into a washing machine to reach a preset level; and repeating a heating rinsing program and a clear water replacement rinsing program in sequence until detecting that the water
(Continued)

purifying module is clean, wherein the heating rinsing program comprises a washing water heating step, a membrane rinsing step, a standing step and a membrane air washing step. The water purifying module self-cleaning method can peel off impurities, macromolecular particles and the like from the surface of a filter system (5) of a water purifying module, thus ensuring the water purifying effect of the water purifying module and effectively prolonging the service life of the water purifying module.

15 Claims, 3 Drawing Sheets

(51) Int. Cl.

| | |
|---|---|
| ***D06F 39/10*** | (2006.01) |
| ***D06F 33/02*** | (2006.01) |
| ***D06F 39/04*** | (2006.01) |
| ***D06F 43/08*** | (2006.01) |
| ***A47L 15/00*** | (2006.01) |
| ***A47L 15/42*** | (2006.01) |
| ***D06F 39/08*** | (2006.01) |
| *D06F 35/00* | (2006.01) |

(52) U.S. Cl.
CPC ..... *A47L 15/4208* (2013.01); *D06F 33/02* (2013.01); *D06F 39/006* (2013.01); *D06F 39/04* (2013.01); *D06F 39/082* (2013.01); *D06F 39/10* (2013.01); *D06F 43/085* (2013.01); *D06F 35/005* (2013.01)

(56) References Cited

FOREIGN PATENT DOCUMENTS

| | | | |
|---|---|---|---|
| JP | 04-210091 | A | 7/1992 |
| WO | WO 2011/147009 | A3 | 12/2011 |

OTHER PUBLICATIONS

Written Opinion (PCT/ISA/237) dated Jul. 21, 2016, by the Chinese Patent Office as the International Searching Authority for International Application No. PCT/CN2016/079405.

* cited by examiner

WATER PURIFYING MODULE SELF-CLEANING METHOD AND WASHING MACHINE USING SAME

TECHNICAL FIELD

The present disclosure relates to the technical field of washing machines, in particular to a water purifying module self-cleaning method and a washing machine using the method.

BACKGROUND ART

With the improvement of people's living standards, washing machines have gradually become one of the necessary home appliances, and most people wash clothes by means of washing machines. With the deterioration of the environment and water pollution, clean water resources have gradually become a scarce resource, how to save water and electricity while washing clothes has been one of concerns of consumers.

A water purification washing machine is researched and developed in such a case. According to the working principle of the water purification washing machine, a water purifying module is arranged in the washing machine, and through introducing washing water into the water purifying model for filtering during the rinsing process and then returning the filtered washing water into the washing barrel of the washing machine, water in the washing barrel is clean during the whole rinsing process and clothes are always washed in the clean water, thus improving the use experience of users.

However, in order to purify the water in the washing barrel to achieve the purpose of recycling, the filter system of the water purifying module adopts a filter screen of which the pore size is at a nanometer level. After using for a period of time, there will inevitably be impurities, macromolecules and the like absorbed on the surface of the filter system. If impurities, macromolecules and the like cannot be peeled off from the filter system, then the water purifying module will fail to function after a period of time, and the effect of washing with clean water cannot be reached, and even pollution to the washing water will be caused.

The existing washing machine self-cleaning program is applicable to washing the inner barrel of a washing machine, instead of washing the water purifying module, which will inevitably exacerbate the failure of the water purifying module. Once the water purifying module fails to function, the user has to change the filter system of the water purifying module, thus increasing the economic burden.

Therefore, how to achieve self-cleaning of the water purifying module is of great significance to maintain the effectiveness of a filter module, extend the service life of the lifter module and improve the user's use experience.

The present disclosure is provided in view of this.

SUMMARY OF THE DISCLOSURE

In order to solve the above problem, the present disclosure provides a water purifying module self-cleaning method and a washing machine using the method, and particularly adopts the following technical solution:

A water purifying module self-cleaning method comprises: starting a water purifying module self-cleaning program to feed water into a washing machine to reach a preset level; and repeating a heating rinsing program and a clear water replacement rinsing program in sequence until detecting that a water purifying module is clean, wherein the heating rinsing program comprises a washing water heating step, a membrane rinsing step, a standing step and a membrane air washing step.

Further, the water purifying module self-cleaning program is started when it is detected that the return flow rate of the water purifying module is less than a set value; and the water purifying module is clean when it is determined that the return flow rate of the water purifying module returns to a normal value.

Further, the heating rinsing program comprises multiple heating rinsing processes, each heating rinsing process comprises a washing water heating step, a membrane rinsing step, a standing step and a membrane air washing step, and a water replenishing program is performed between every two adjacent heating rinsing processes;

wherein the water replenishing program comprises a step of replenishing water into the washing machine until the water level reaches a set level.

Further, a washing water draining program and a water feeding program are performed between the heating rinsing process and the clear water replacement rinsing program;

wherein the washing water draining program comprises a step of draining washing water used in the heating rinsing program and the water feeding program comprises a step of feeding water into the washing machine to reach a set level.

Further, the clear water replacement rinsing program comprises a washing water stirring step, a membrane rinsing step, a membrane air washing (water recycling) step and a washing water draining step.

Further, the time of the membrane rinsing step is 5-10 seconds, the time of the standing step is 60-80 times that of the membrane rinsing step, the time of the membrane air washing step is 24-30 times that of the membrane rinsing step, the time of the washing water stirring step is 24-30 times that of the membrane rinsing step, and the time of the membrane air washing (water recycling) step is 60-80 times that of the membrane rinsing step.

Further, the water purifying module self-cleaning method of the present disclosure comprises the following steps:

Step S1: starting the water purifying module self-cleaning program;

Step S2: feeding water to a set level;

Step S3: carrying out a heating rinsing program;

Step S4: draining washing water;

Step S5: feeding water to a set level;

Step S6: carrying out a clear water replacement rinsing program; and

Step S7: repeating steps S2-S6 until the water flow of the water purifying module returns to normal.

Further, the step S3 comprises the following steps:

Step S31: allowing the washing machine to carry out a washing program and heating rinsing water to a set temperature at the same time;

Step S32: carrying out membrane rinsing;

Step S33: standing still;

Step S34: carrying out membrane air washing;

Step S35: repeating steps S32-S34 at least five times;

Step S36: allowing the washing machine to detect and determine whether the water level reaches a set level; if the determination result is positive, switching on a main water inlet valve of the washing machine to replenish water to the set level and then returning to the step S31; if the determination result is negative, returning to the step S31.

The present disclosure furthermore provides a washing machine using the water purifying module self-cleaning method, wherein the washing machine comprises a first head pump and a second head pump, the first head pump and the second head pump are respectively connected to a washing barrel and a water purifying module. The water purifying module comprises a filter system, an air pump, a self-priming pump and a sewage valve, and the air pump, the self-priming pump and the sewage valve are respectively connected with the filter system. And in the membrane rinsing step, the first head pump and the sewage valve are switched on; in the standing step, the first head pump, the second head pump, the air pump, the self-priming pump and the sewage valve are all switched off; in the membrane air washing step, the second head pump, the air pump and the sewage valve are all switched on.

Further, a flow sensor is arranged on a pipeline between the filter system and the self-priming pump or on a pipeline between the self-priming pump and the washing barrel.

The water purifying module self-cleaning method of the present disclosure has the following advantages:

1) By detecting the return flow rate of the water purifying module to judge its use situation, when the water purifying module is contaminated seriously, the self-cleaning program of the water purifying module is started timely to wash the water purifying module to ensure the effectiveness of the water purifying module.

2) The water purifying module self-cleaning method of the present disclosure comprises a heating rinsing program and it greatly improves the washing effect by heating the washing water first and then carrying out the membrane rinsing step, the membrane air washing step and the like on the water purifying module.

3) According to the water purifying module self-cleaning method of the present disclosure, the washing water is continuously stirred and heated in the washing barrel during the self-cleaning process of the water purifying module. Therefore, the self-cleaning effect for the washing barrel of the washing machine is achieved while the self-cleaning effect of the water purifying module is realized.

Therefore, the water purifying module self-cleaning method of the present disclosure can peel off the impurities, macromolecular particles and the like from the surface of the filter system of the water purifying module in time to ensure the water purification effect of the water purifying module, effectively prolong the service life of the water purifying module and greatly enhance the user's use experience.

DESCRIPTION OF REFERENCE NUMERALS

Figure 1:
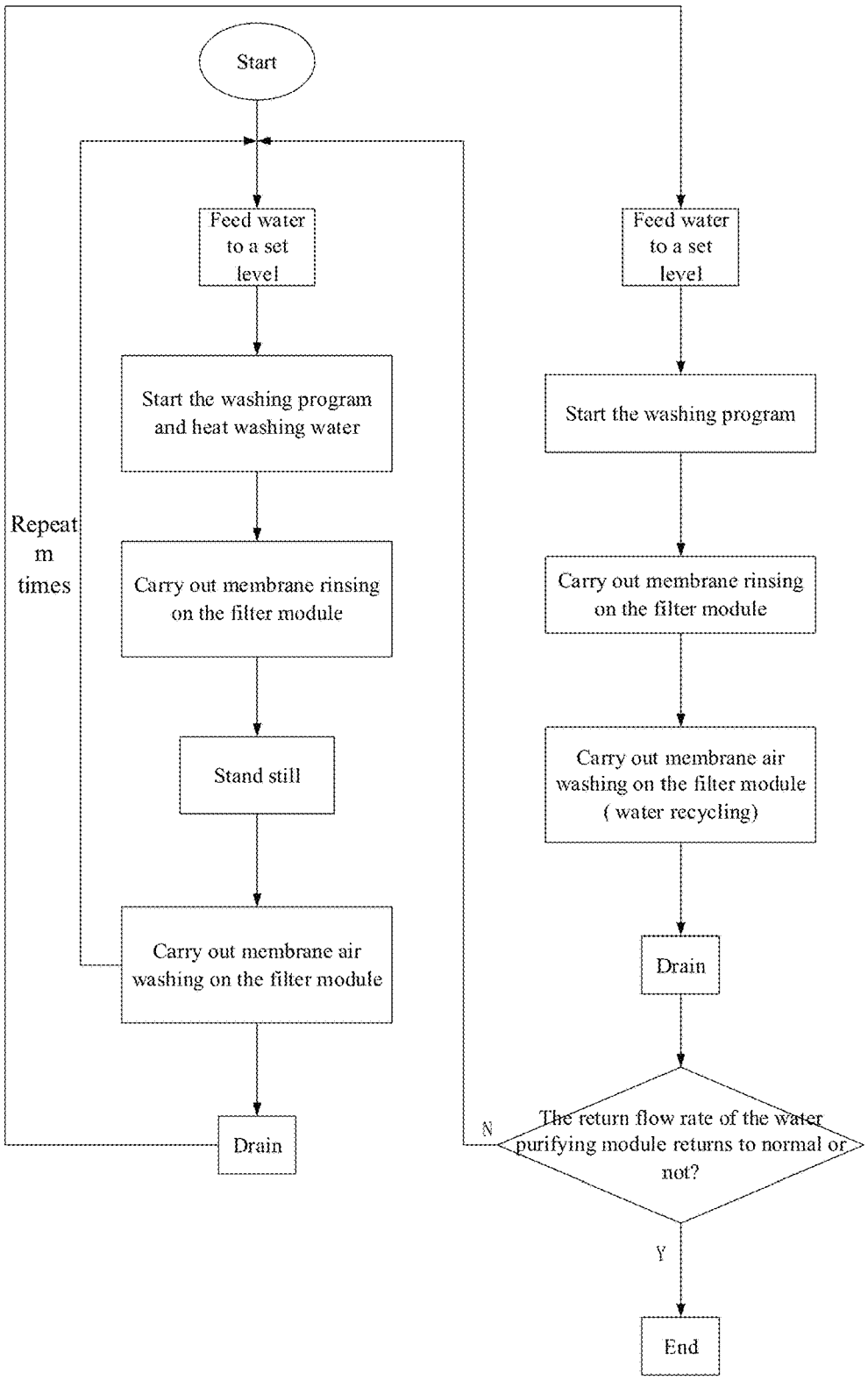
FIG. 1 is a flow block diagram according to the present disclosure.
Figure 2:
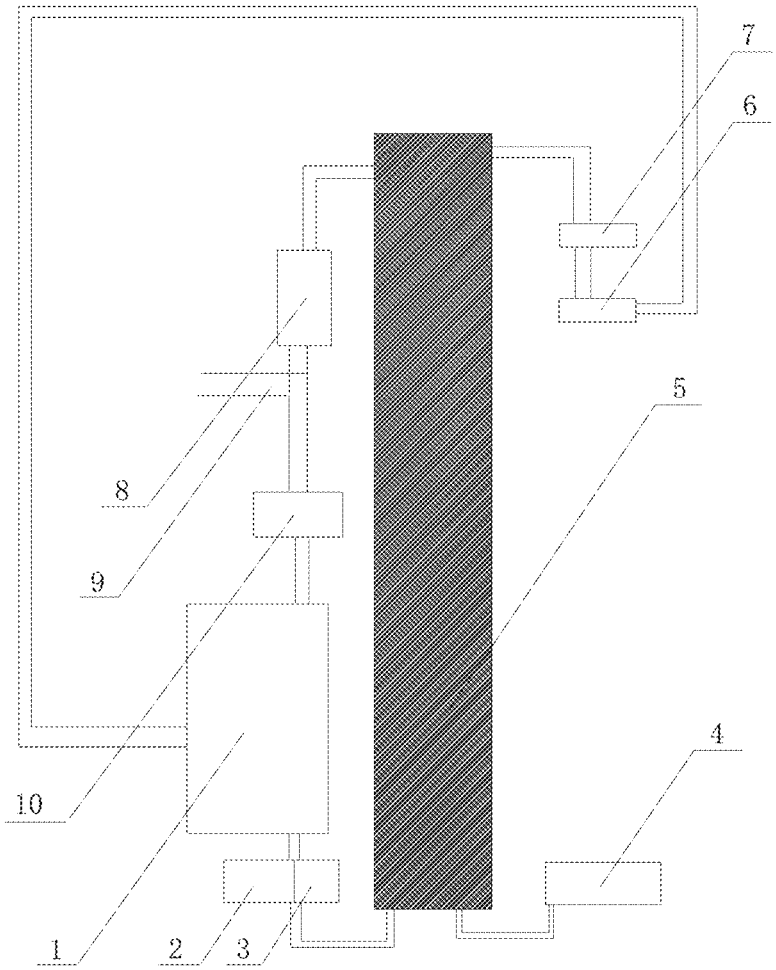
FIG. 2 is a schematic diagram of the structural connection of the washing machine according to the present disclosure.
Figure 3:
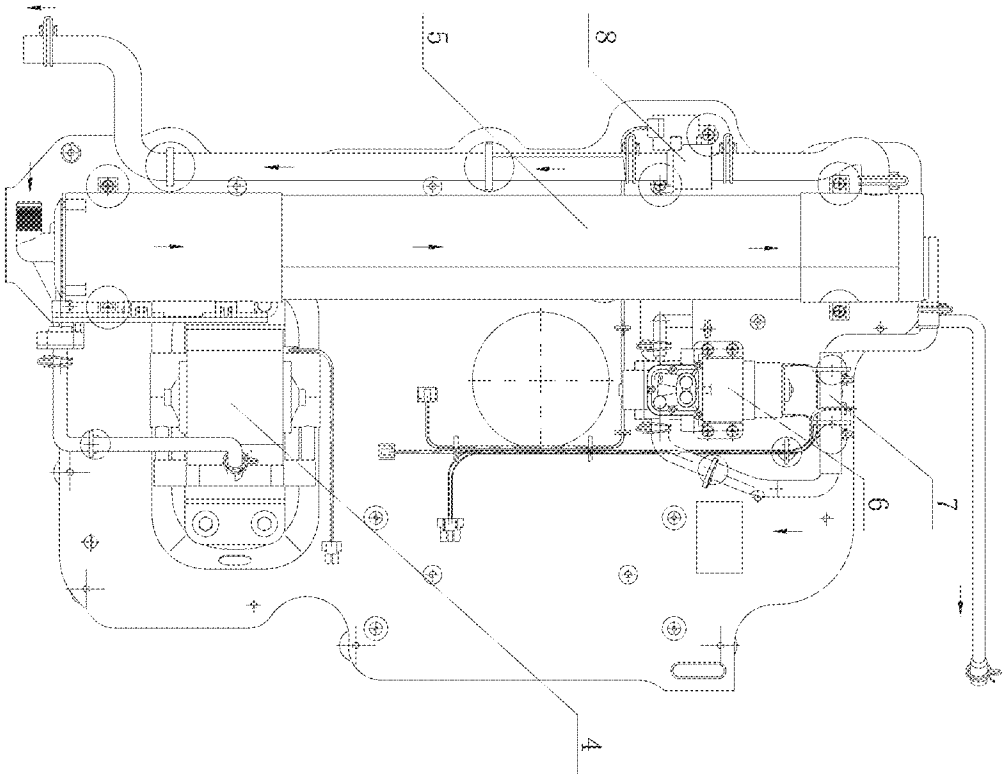
FIG. 3 is a schematic diagram of the structure of a water purifying module according to the present disclosure.

1—washing barrel; 2—first head pump; 3—second head pump; 4—air pump; 5—filter system; 6—self-priming pump; 7—flow sensor; 8—drain valve; 9—drain pipe; 10—drain valve.

DETAILED DESCRIPTION OF THE DISCLOSURE

The water purifying module self-cleaning method according to the present disclosure and the washing machine using the method will be described in detail with reference to the accompanying drawings:

The water purifying module self-cleaning method comprises: starting a water purifying module self-cleaning program to feed water into a washing machine to reach a preset level; and repeating a heating rinsing program and a clear water replacement rinsing program in sequence until detecting that the water purifying module is clean, wherein the heating rinsing program comprises a washing water heating step, a membrane rinsing step, a standing step and a membrane air washing step.

Further, the water purifying module self-cleaning program is started when it is detected that the return flow rate of the water purifying module is less than a set value; the water purifying module is clean when it is determined that the return flow rate of the water purifying module returns to a normal value.

According to the water purifying module self-cleaning method of the present disclosure, a determination of a degree of pollution of the water purifying module is made through detecting the return flow rate to the water purifying module. When the water return flow of the water purifying module is too small, it means that attachment to the filter system of the water purifying module is serious, and then the user needs to be reminded of starting the water purifying module self-cleaning program to perform self-cleaning on the water purifying module. Therefore, the water purifying module self-cleaning module of the present disclosure can effectively detect the degree of dirt attachment to the water purifying module in real time and timely remind the user of cleaning to ensure the effectiveness of the water purifying module and improve the service life.

For the set value of the return flow rate of the present disclosure, its specific value is determined comprehensively by a large number of tests and it can be set by the user or can be the default setting of the computer board of the washing machine.

The water purifying module self-cleaning method of the present disclosure and also detects and determines the return flow rate of the water purifying module during the cleaning process. When the return flow rate returns to normal, it means that the cleaning of the water purifying module is completed. How to determine whether the return flow rate returns to normal, a normal value of the return flow rate can be set, when the detected return flow rate is greater than or equal to the normal value, that is to say, the filtering function of the water purifying module is recovered and the water purifying module self-cleaning program can be ended.

For the heating rinsing program of the present disclosure, the washing water is stirred and heated firstly according to the existing washing program of the washing machine, and then the membrane rinsing step, the membrane air washing step and the like are carried out. Using of warm water can ensure a better washing effect, and the washing efficiency is improved.

In addition, it is possible to add a related acidic or alkaline washing chemical to the washing water in the heating rinsing program, and the washing chemical chemically reacts with the dirt on the water purifying module to further accelerate the peeling of the dirt on the water purifying module, which enhances the washing effect, and improves the washing efficiency.

Since the heating rinsing program of the present disclosure mainly refers to a process of washing dirt away from the filter system, it is necessary to set the time of the heating rinsing program to be long to ensure the effectiveness of the heating rinsing program. However, the temperature of the washing water determines the washing effect of the heating rinsing program to a certain extent, and if the time of the heating rinsing program is too long, the temperature of the washing water will drop significantly, affecting the effect of heating rinsing program.

Therefore, the heating rinsing program of the present disclosure comprises multiple heating rinsing processes, each heating rinsing process comprises a washing water heating step, a membrane rinsing step, a standing step and a membrane air washing step, and a water replenishing program is performed between every two adjacent heating rinsing processes; wherein the water replenishing program comprises a step of replenishing water into the washing machine until the water level reaches a set level. Therefore, the heating rinsing program is divided into a plurality of heating rinsing processes, each of which includes complete washing water heating, membrane rinsing, standing and membrane air washing steps. Thus, it avoids the decrease of the temperature of the washing water due to the time course, thus achieving a better washing effect.

In addition, since dirt is discharged together with washing water in the membrane rinsing and membrane air washing steps, this will result in a decrease in the amount of washing water. Therefore, in order to ensure that the amount of washing water meets the water level requirement, water replenishing is required before the next heating rinsing process. Specifically, the water replenishing program comprises: allowing the washing machine to detect and determine whether the water level reaches a set level; if the determination result is positive, switching on a main water inlet valve of the washing machine to replenish water to the set level; if the determination result is negative, carrying out the washing water heating step. The water replenishing program of the present disclosure ensures the amount of washing water during each heating rinsing process, and only sufficient washing water can ensure the washing effects of the membrane rinsing step and the membrane air washing step.

The water purifying module self-cleaning method of the present disclosure comprises alternately performing the heating rinsing program and the clear water replacement rinsing program in turn. Dirt washed off in each heating rinsing program is discharged in time, and is further rinsed and discharged by the water replacement rinsing program. Therefore, repeated deposition of dirt can be avoided and the self-cleaning efficiency of the water purifying module is improved.

Therefore, the washing water draining program and the water feeding program are performed between the heating rinsing program and the clear water replacement rinsing program, wherein the washing water draining program comprises the step of draining the washing water used in the heating rinsing program, and the water feeding program comprises the step of allowing the washing machine to feed water to a set level.

The clear water replacement rinsing program of the present disclosure mainly refers to washing away the left dirt after the heating rinsing program, the clear water replacement rinsing program determines the final self-cleaning effect of the water purifying module. Therefore, the clear water replacement rinsing program of the present disclosure comprises a washing water stirring step, a membrane rinsing step, a membrane air washing (water recycling) step and a washing water draining step. Wherein the membrane rinsing is to wash away and discharge dirt attached to the filter system, and membrane air washing (water recycling) refers to constantly charge air into the washing water of the filter system so that air flow moves upward continuously to vibrate the dirt on the filter system and make the dirt fall off and discharged completely through the washing water draining step. Therefore, the clear water replacement rinsing program of the present disclosure is capable of discharging dirt left on the filter system to the outside to the greatest extent.

As a preferred embodiment of the present disclosure, the time of the membrane rinsing step is 5-10 seconds, the time of the standing step is 60-80 times that of the membrane rinsing step, the time of the membrane air washing step is 24-30 times that of the membrane rinsing step, the time of the washing water stirring step is 24-30 times that of the membrane rinsing step, and the time of the membrane air washing (water recycling) step is 60-80 times that of the membrane rinsing step.

Wherein, the washing water heating step, the membrane rinsing step, the standing step and the membrane air washing step are repeated at least five times during each heating rinsing process of the heating rinsing program so that the dirt can be peeled off from the filter system as much as possible. The membrane rinsing and membrane air washing (water recycling) in the clear water replacement program are respectively carried out once, with a main purpose of washing off the dirt and completely discharging it.

Particularly, the water purifying module self-cleaning method of the present disclosure comprises the following steps:

Step S1: starting the water purifying module self-cleaning program;

Step S2: feeding water to a set level;

Step S3: carrying out a heating rinsing program;

Step S4: draining washing water;

Step S5: feeding water to a set level;

Step S6: carrying out a clear water replacement rinsing program; and

Step S7: repeating steps S2-S6 until the water flow of the water purifying module returns to normal.

Further, the step S3 comprises the following steps:

Step S31: allowing the washing machine to carry out a washing program and heating rinsing water to a set temperature at the same time;

Step S32: carrying out membrane rinsing;

Step S33: standing still;

Step S34: carrying out membrane air washing;

Step S35: repeating steps S32-S34 at least five times;

Step S36: allowing the washing machine to detect and determine whether the water level reaches a set level; if the determination result is positive, switching on a main water inlet valve of the washing machine to replenish water to the set level and then returning to the step S31; if the determination result is negative, returning to the step S31.

The water purifying module self-cleaning method of the present disclosure can peel off the impurities, macromolecular particles and the like from the surface of the filter system of the water purifying module in time to ensure the water purification effect of the water purifying module, effectively prolong the service life of the water purifying module and greatly enhance the user's use experience.

In addition, according to the water purifying module self-cleaning method of the present disclosure, the washing water is continuously stirred and heated in the washing barrel during the self-cleaning process of the water purifying module. Therefore, the self-cleaning effect for the washing barrel of the washing machine is achieved while the self-cleaning effect of the water purifying module is realized.

Embodiment 1

As shown in FIG. 1, the water purifying module self-cleaning method in this embodiment comprises the following steps:

1) starting;
2) feeding water to a set level;
3) starting a washing program to heat washing water;
4) carrying out membrane rinsing on a filter module
5) standing still;
6) carrying out membrane air washing on the filter module;
7) draining;
8) repeating steps 2)-7) for m times;
9) feeding water to a set level;
10) starting a washing program;
11) carrying out membrane rinsing on the filter module
12) carrying out membrane air washing on the filter module (recycling);
13) draining:
14) determining whether the return flow rate of the water purifying module returns to normal or not; and
15) if the determination result is positive, ending the operation, and if the determination result is negative, returning to step 2).

When the determination results obtained after step 14) of this embodiment is carried out three times in succession are all negative, an alarm is made to remind the user of checking the water purifying module or changing the filter system of the water purifying module.

The water purifying module self-cleaning method of this embodiment can peel off the impurities, macromolecular particles and the like from the surface of the filter system of the water purifying module in time to ensure the water purification effect of the water purifying module, effectively prolong the service life of the water purifying module and greatly enhance the user's use experience.

Embodiment 2

The present disclosure provides a specific program flow of the water purifying module self-cleaning method according to the present disclosure:

Washing schedule

| | | Self-cleaning | Time | On/off ratio |
|---|---|---|---|---|
| Standby state | Standby state | Switch off all outputs | / | / |
| Start a program operation state | Start a program operation state | Press the START key to enter the program operation state, lock the door, and alarm if the door cannot be locked | / | / |
| Water feeding | | Feed water to a set level via the valve. | | |
| Heating rinsing 1 | Washing + heating | Heat to a set temperature while washing, and if the water level is lower than a set level, feed water to the set level through the main water inlet valve | Heating time | 45 3/117 |
| | Membrane rinsing | Switch on the first head pump and the sewage valve | 5 s | Repeat 5 times |
| | Stand still | Switch off the first head pump and the sewage valve | 300 s | |
| | Membrane air washing | Switch on the second head pump, the air pump and the sewage valve | 120 s | |
| Heating rinsing 2 | Washing + heating | Heat to a set temperature while washing, and if the water level is lower than a set level, feed water to the set level through the main water inlet valve | Heating time | 45 3/117 |
| | Membrane rinsing | Switch on the first head pump and the sewage valve | 5 s | Repeat 5 times |
| | Stand still | Switch off the first head pump and the sewage valve | 300 s | |
| | Membrane air washing | Switch on the second head pump, the air pump and the sewage valve | 120 s | |
| Drain up | Membrane rinsing (draining) | Switch on the first head pump and the sewage valve to drain up the barrel | 125 s | |
| | Water feeding | Feed water to a set level | | |
| Clear water replacement rinsing | Stirring | Start washing | 120 s | 45 rpm 10/6 |
| | Membrane rinsing | Switch on the first head pump and the sewage valve | 5 s | |
| | Recycling | Switch on the second head pump, the self-priming pump, the sewage valve and the air pump | 300 s | 45 rpm 10/6 |
| | Membrane rinsing (draining) | Drain to reach the empty-barrel level, switch on the first head pump and the sewage valve | 120 s | |
| Heating rinsing 3 | Water feeding | Feed water to a set level | | |
| | Washing + heating | Heat to a set temperature while washing | Heating time | 45 3/117 |
| | Membrane rinsing | Switch on the first head pump and the sewage valve | 5 s | Repeat 5 times |
| | Stand still | Switch off the first head pump and the sewage valve | 300 s | |

-continued

| Washing schedule | | | | |
|---|---|---|---|---|
| | | Self-cleaning | Time | On/off ratio |
| | Membrane air washing | Switch on the second head pump, the air pump and the sewage valve | 120 s | |
| | Drain | Drain to reach the empty-barrel level, switch on the first head pump and the sewage valve | 125 s | |
| | Water feeding | Feed water to a set level | | 45 3/117 |
| Clear water replacement rinsing | Stirring | Start washing if the water level is lower than a set level | 120 s | 45 rpm 10/6 |
| | Membrane rinsing | Switch on the first head pump and the sewage valve | 5 s | |
| | Recycling | Switch on the second head pump, the self-priming pump, the sewage valve and the air pump | 300 s | 45 rpm 10/6 |
| | Membrane rinsing (draining) | Drain to reach the empty-barrel level, switch on the first head pump and the sewage valve | 120 s | |
| End | Switch off all loads | Switch off all loads, unlock the door, and end the operation | 120 s | |

The heating rinsing of the water purifying module self-cleaning flow of this embodiment includes heating rinsing 1, heating rinsing 2 and heating rinsing 3 to ensure that the water purifying module is cleaned to the greatest extent and the clear water replacement rinsing performed after the heating rinsing can ensure the discharging of the dirt left after the heating rinsing to the greatest extent. Therefore, the self-cleaning flow of this embodiment can meet the self-cleaning requirements of most of water purifying models.

Embodiment 3

This embodiment discloses a washing machine using the water purifying module self-cleaning method according to the present disclosure, wherein the washing machine comprises a first head pump and a second head pump, the first head pump and the second head pump are respectively connected to a washing barrel and a water purifying module. The water purifying module comprises a filter system, an air pump, a self-priming pump and a sewage valve, and the air pump, the self-priming pump and the sewage valve are respectively connected with the filter system. And in the membrane rinsing step, the first head pump and the sewage valve are switched on; in the standing step, the first head pump, the second head pump, the air pump, the self-priming pump and the sewage valve are all switched off; in the membrane air washing step, the second head pump, the air pump and the sewage valve are all switched on.

A flow sensor is arranged on a pipeline between the filter system and the self-priming pump or on a pipeline between the self-priming pump and the washing barrel according to this embodiment. The flow sensor detects the return flow rate of the filter system in real time and sends it to the computer board of the washing machine. The computer board of the washing machine monitors the dirt attachment to the filter system according to the return flow rate, thereby providing a basis for the user to start and stop the self-cleaning program of the water purifying module.

The foregoing is merely illustrative of the preferred embodiments of the present disclosure and is not intended to limit the present disclosure in any form. While the present disclosure has been disclosed as above by way of the preferred embodiments, it is not intended to be limiting of the present disclosure. Any person skilled in the art may make some changes or equivalent embodiments modified as equivalents without departing from the scope of the present disclosure on the basis of the above-mentioned technical contents; any of changes, equivalent, and modifications made to the foregoing embodiments without departing from the spirit of the technical solution of the present disclosure in accordance with the technical essence of the present disclosure is within the scope of the present disclosure.

The invention claimed is:

1. A water purifying module self-cleaning method, comprising: starting a water purifying module self-cleaning program to feed water into a washing machine to reach a preset level; and repeating a heating rinsing program and a clear water replacement rinsing program until detecting that a water purifying module is clean, wherein the heating rinsing program comprises a washing water heating step, a membrane rinsing step, a standing step and a membrane air washing step.

2. The water purifying module self-cleaning method according to claim 1, further comprises: starting the water purifying module self-cleaning program when a return flow rate of the water purifying module is detected to be less than a set value; and determining the water purifying module is clean when the return flow rate of the water purifying module is detected to return to a normal value.

3. The water purifying module self-cleaning method according to claim 1, wherein the heating rinsing program comprises multiple heating rinsing processes, each heating rinsing process comprises the washing water heating step, the membrane rinsing step, the standing step and the membrane air washing step, and a water replenishing program is performed between every two adjacent heating rinsing processes;

wherein the water replenishing program comprises a step of replenishing water into the washing machine until a water level reaches a set level.

4. The water purifying module self-cleaning method according to claim 1, wherein a washing water draining program and a water feeding program are performed between the heating rinsing process and the clear water replacement rinsing program;

wherein the washing water draining program comprises a step of draining washing water which is used in the heating rinsing program, and the water feeding program comprises a step of feeding water into the washing machine to reach a set level.

5. The water purifying module self-cleaning method according to claim 1, wherein the clear water replacement rinsing program comprises a washing water stirring step, the membrane rinsing step, the membrane air washing step and a washing water draining step.

6. The water purifying module self-cleaning method according to claim 5, wherein a time of the membrane rinsing step is in a range of 5-10 seconds, a time of the standing step is in a range of 60-80 times that of the membrane rinsing step, a time of the membrane air washing step is in range of 24-30 times that of the membrane rinsing step, a time of the washing water stirring step is in a range of 24-30 times that of the membrane rinsing step, and a time of the membrane air washing step is in a range of 60-80 times that of the membrane rinsing step.

7. The water purifying module self-cleaning method according to claim 1, comprising the following steps:

Step S1: starting the water purifying module self-cleaning program;

Step S2: feeding water to the preset level;

Step S3: carrying out a heating rinsing program;

Step S4: draining washing water;

Step S5: feeding water to the preset level;

Step S6: carrying out the clear water replacement rinsing program; and

Step S7: repeating steps S2-S6 until a water flow of the water purifying module returns to normal.

8. The water purifying module self-cleaning method according to claim 7, wherein the step S3 comprises the following steps:

Step S31: allowing the washing machine to carry out a washing program while heating rinsing water to a set temperature;

Step S32: carrying out membrane rinsing;

Step S33: standing still;

Step S34: carrying out membrane air washing;

Step S35: repeating steps S32-S34 at least five times;

Step S36: allowing the washing machine to detect and determine whether a water level reaches the preset level; if the determination result is positive, switching on a main water inlet valve of the washing machine to replenish water to the preset level and then returning to the step S31; if the determination result is negative, returning to the step S31.

9. A washing machine using a water purifying module self-cleaning method according to claim 1, comprising a first head pump and a second head pump, wherein, the first head pump and the second head pump are respectively connected to a washing barrel and a water purifying module, the water purifying module comprises a filter system, an air pump, a self-priming pump and a sewage valve, and the air pump, the self-priming pump and the sewage valve are respectively connected with the filter system; and in the membrane rinsing step, the first head pump and the sewage valve are switched on; in the standing step, the first head pump, the second head pump, the air pump, the self-priming pump and the sewage valve are all switched off;

in the membrane air washing step, the second head pump, the air pump and the sewage valve are all switched on.

10. The washing machine according to claim 9, wherein a flow sensor is arranged on a pipeline between the filter system and the self-priming pump or on a pipeline between the self-priming pump and the washing barrel.

11. A washing machine using a water purifying module self-cleaning method according to claim 2, comprising a first head pump and a second head pump, wherein, the first head pump and the second head pump are respectively connected to a washing barrel and a water purifying module, the water purifying module comprises a filter system, an air pump, a self-priming pump and a sewage valve, and the air pump, the self-priming pump and the sewage valve are respectively connected with the filter system; and in the membrane rinsing step, the first head pump and the sewage valve are switched on; in the standing step, the first head pump, the second head pump, the air pump, the self-priming pump and the sewage valve are all switched off;

in the membrane air washing step, the second head pump, the air pump and the sewage valve are all switched on.

12. A washing machine using a water purifying module self-cleaning method according to claim 3, comprising a first head pump and a second head pump, wherein, the first head pump and the second head pump are respectively connected to a washing barrel and a water purifying module, the water purifying module comprises a filter system, an air pump, a self-priming pump and a sewage valve, and the air pump, the self-priming pump and the sewage valve are respectively connected with the filter system; and in the membrane rinsing step, the first head pump and the sewage valve are switched on; in the standing step, the first head pump, the second head pump, the air pump, the self-priming pump and the sewage valve are all switched off;

in the membrane air washing step, the second head pump, the air pump and the sewage valve are all switched on.

13. A washing machine using a water purifying module self-cleaning method according to claim 4, comprising a first head pump and a second head pump, wherein, the first head pump and the second head pump are respectively connected to a washing barrel and a water purifying module, the water purifying module comprises a filter system, an air pump, a self-priming pump and a sewage valve, and the air pump, the self-priming pump and the sewage valve are respectively connected with the filter system; and in the membrane rinsing step, the first head pump and the sewage valve are switched on; in the standing step, the first head pump, the second head pump, the air pump, the self-priming pump and the sewage valve are all switched off;

in the membrane air washing step, the second head pump, the air pump and the sewage valve are all switched on.

14. A washing machine using a water purifying module self-cleaning method according to claim 5, comprising a first head pump and a second head pump, wherein, the first head pump and the second head pump are respectively connected to a washing barrel and a water purifying module, the water purifying module comprises a filter system, an air pump, a self-priming pump and a sewage valve, and the air pump, the self-priming pump and the sewage valve are respectively connected with the filter system; and in the membrane rinsing step, the first head pump and the sewage valve are switched on; in the standing step, the first head pump, the second head pump, the air pump, the self-priming pump and the sewage valve are all switched off;

in the membrane air washing step, the second head pump, the air pump and the sewage valve are all switched on.

15. A washing machine using a water purifying module self-cleaning method according to claim 7, comprising a first head pump and a second head pump, wherein, the first head pump and the second head pump are respectively connected to a washing barrel and a water purifying module, the water purifying module comprises a filter system, an air pump, a self-priming pump and a sewage valve, and the air pump, the self-priming pump and the sewage valve are respectively connected with the filter system; and in the membrane rinsing step, the first head pump and the sewage valve are switched on; in the standing step, the first head pump, the second head pump, the air pump, the self-priming pump and the sewage valve are all switched off;

in the membrane air washing step, the second head pump, the air pump and the sewage valve are all switched on.

* * * * *